US010051897B2

(12) United States Patent
Freddi et al.

(10) Patent No.: US 10,051,897 B2
(45) **Date of Patent: *Aug. 21, 2018**

(54) GARMENT FOR SHAPING THE FEMALE BUTTOCKS AND HIPS, IN PARTICULAR A SPORTS GARMENT FOR DANCE OR GYMNASTICS

(71) Applicant: FREDDY S.p.A., Milan (IT)

(72) Inventors: Carlo Freddi, Chiavari (IT); Margherita Freddi, Leivi (IT)

(73) Assignee: FREDDY S.P.A., Milan (IT)

( * ) Notice: Subject to any disclaimer, the term of this patent is extended or adjusted under 35 U.S.C. 154(b) by 711 days.

This patent is subject to a terminal disclaimer.

(21) Appl. No.: 13/898,184

(22) Filed: May 20, 2013

(65) Prior Publication Data

US 2013/0316617 A1 Nov. 28, 2013

(30) Foreign Application Priority Data

May 24, 2012 (IT) ..... MI2012A0907

(51) Int. Cl.
*A41D 1/06* (2006.01)
*A41D 1/08* (2018.01)
(Continued)

(52) U.S. Cl.
CPC ..... *A41D 1/08* (2013.01); *A41D 13/0017* (2013.01); *A41D 1/06* (2013.01); *A41D 2300/22* (2013.01);
(Continued)

(58) Field of Classification Search
CPC . A41D 1/06; A41D 1/067; A41D 1/08; A41D 13/0017; A41D 2300/20; A41D 2300/22; A41D 2400/38; A41D 2600/10
(Continued)

(56) References Cited

U.S. PATENT DOCUMENTS 281,790 A * 7/1883 Pearson ..... A41D 1/06 2/227
750,983 A * 2/1904 Kendrick ..... A41C 1/00 450/116

(Continued)

FOREIGN PATENT DOCUMENTS

CN 1174685 A 3/1998
CN 1233942 A 11/1999

(Continued)

OTHER PUBLICATIONS

Office Action dated Jun. 17, 2015 from U.S. Appl. No. 13/898,097 to Carlo Freddi et al. filed May 20, 2013.

(Continued)

*Primary Examiner* — Jameson Collier
*Assistant Examiner* — James Heracklis
(74) *Attorney, Agent, or Firm* — Vorys, Sater, Seymour and Pease LLP

(57) ABSTRACT

Sports garment for shaping female buttocks and hips, including: rear part covering buttocks except their upper terminal portion, front part at least partially covering the abdomen, and waist part covering at least buttocks terminal upper portion. The rear part includes two rear elements; each including: first portions to cover: buttocks lower terminal portion, buttocks lateral portion, and hips portion; and second portions to cover: buttocks central portion and lower central portion at the garment rear fork. The rear part includes an insert increasing elastic modulus and/or tenacity of the rear part first portions relative to second portions. Lateral edges of two rear part rear elements connect along a central rear seam positioned on the buttocks intergluteal cleft; before sewing together, the lateral edges have rectilinear shape in plan view, facilitating seam insertion into the (Continued)

Figure 1:
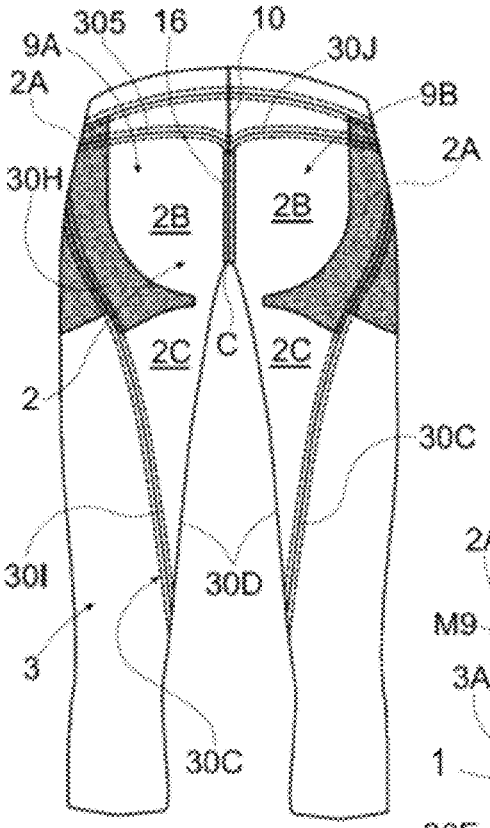

intergluteal cleft and adherence of the two elements to buttocks when wearing pants.

20 Claims, 9 Drawing Sheets

(51) Int. Cl.
*A41D 13/02* (2006.01)
*A41D 13/00* (2006.01)

(52) U.S. Cl.
CPC ..... *A41D 2400/38* (2013.01); *A41D 2600/10* (2013.01)

(58) Field of Classification Search
USPC ..... 2/227, 228, 238, 237, 236, 400; 450/95, 450/98–101, 115–118, 122–124
See application file for complete search history.

(56) References Cited

U.S. PATENT DOCUMENTS 1,863,482 A * 6/1932 Isaacs ..... A41D 1/08 2/228
2,043,538 A * 6/1936 Hardie ..... A41F 9/02 112/414
2,344,374 A * 3/1944 Stephens ..... A41B 9/04 2/401
2,565,866 A 8/1951 Loftus
2,569,229 A * 9/1951 Cooper ..... A41C 1/003 2/407
2,629,094 A * 2/1953 Goldsmith ..... A41D 1/08 2/23
2,668,953 A 2/1954 Ellen
2,898,918 A * 8/1959 Roura ..... A41B 9/04 2/406
2,928,397 A 3/1960 Pucci
3,035,586 A * 5/1962 Bell ..... A41C 1/003 450/100
3,068,871 A * 12/1962 Rapp ..... A41D 1/06 450/95
3,194,241 A 7/1965 Leoffel
3,339,554 A 9/1967 Nobbs
3,406,692 A 10/1968 Pernas
3,438,376 A * 4/1969 Murdock ..... A41C 1/003 450/104
3,459,193 A 8/1969 Krieger
3,526,229 A * 9/1970 Blair ..... A41C 1/003 450/104
3,813,697 A 6/1974 Belpaume
3,835,866 A * 9/1974 Brooks ..... A41C 1/003 450/123
3,877,439 A * 4/1975 Locascio ..... A41C 1/02 450/123
3,894,542 A * 7/1975 Sacristan ..... A41C 1/003 450/123
3,974,836 A 8/1976 Carlson
3,996,622 A 12/1976 Cooke
4,184,494 A 1/1980 King, Jr.
4,261,060 A * 4/1981 Zawacki ..... A41D 1/084 2/227
D262,325 S 12/1981 Miller et al.
4,325,379 A 4/1982 Ozbey
4,392,259 A * 7/1983 Bredo ..... A41D 1/06 2/227
4,625,336 A * 12/1986 Derderian ..... A41D 1/08 2/227
4,843,654 A * 7/1989 March ..... A41D 1/086 2/227
4,850,056 A * 7/1989 Gardner ..... A41D 1/08 2/227
D317,074 S 5/1991 Beasley
5,040,244 A * 8/1991 Tubbs ..... A41F 9/025 2/221
5,159,721 A * 11/1992 Senser ..... A41D 1/06 2/227
5,182,815 A * 2/1993 Young ..... A41B 9/004 2/228
5,201,074 A * 4/1993 Dicker ..... A41D 13/0015 2/227
5,263,923 A * 11/1993 Fujimoto ..... A41D 13/0015 602/62
5,365,610 A * 11/1994 Lubahn ..... A41D 13/015 2/227
5,375,266 A * 12/1994 Crisco ..... A41F 9/025 2/221
5,634,215 A * 6/1997 DeBaene ..... A41D 1/067 2/227
5,649,328 A 7/1997 Martin
5,708,986 A 1/1998 Belardinelli
5,762,535 A 6/1998 Nishiyama et al.
5,784,723 A * 7/1998 Noble ..... A41C 1/003 2/228
5,888,118 A * 3/1999 Kishi ..... A41C 1/003 2/243.1
5,974,592 A 11/1999 Tabrizi
6,041,437 A * 3/2000 Barker ..... A41D 1/067 156/278
6,041,442 A * 3/2000 Owen ..... A41D 1/08 2/227
6,047,406 A * 4/2000 Dicker ..... A41D 13/0015 2/115
RE36,905 E * 10/2000 Noble ..... A41C 1/003 2/228
6,161,222 A * 12/2000 Strickland ..... A41D 1/08 2/228
6,182,297 B1 2/2001 Duren et al.
6,186,970 B1 * 2/2001 Fujii ..... A41D 13/0015 2/22
6,430,752 B1 * 8/2002 Bay ..... A41C 1/003 2/228
6,430,753 B2 * 8/2002 Duran ..... A41B 11/003 2/239
6,532,599 B1 * 3/2003 Dugan ..... A41D 1/08 2/227
6,543,062 B1 * 4/2003 Amsel ..... A41D 1/06 2/227
7,074,204 B2 7/2006 Fujii et al.
7,081,036 B1 * 7/2006 Howard ..... A41C 1/00 450/100
7,087,032 B1 * 8/2006 Ikeda ..... A61F 5/03 128/891
7,143,453 B2 * 12/2006 Duran ..... A41B 11/003 2/409
7,260,961 B1 * 8/2007 Kennedy ..... D04B 1/243 66/171
7,377,834 B2 5/2008 Fu
7,500,274 B1 * 3/2009 Kallen ..... A41D 1/086 2/227
7,526,929 B2 * 5/2009 Takamoto ..... A41B 11/14 66/177
7,533,423 B2 5/2009 Rudolph
7,546,751 B2 6/2009 Lutz
7,574,752 B1 * 8/2009 Walters ..... A41D 1/062 2/227
7,631,367 B2 * 12/2009 Caillibotte ..... A41D 13/0015 2/228
7,670,205 B2 * 3/2010 Oyama ..... A41B 9/001 2/69
7,677,953 B2 * 3/2010 Oyama ..... A41C 1/003 2/228
7,886,367 B2 * 2/2011 Chapuis ..... A41D 13/0015 2/22
7,945,970 B2 * 5/2011 Belluye ..... A41D 13/0015 2/227
8,075,370 B1 * 12/2011 Hancock ..... A41B 9/00 2/400
8,087,098 B2 1/2012 Kimberly et al.
8,336,120 B2 * 12/2012 Wong ..... A41B 9/02 2/238

(56) References Cited

U.S. PATENT DOCUMENTS

D673,756 S * 1/2013 Agnew ..... D2/742
8,381,314 B2 * 2/2013 Takamoto ..... A41D 7/00 2/243.1
8,418,268 B2 * 4/2013 Waldman ..... A41D 1/06 2/227
8,533,864 B1 * 9/2013 Kostrzewski ..... A41D 13/0015 2/69
8,601,615 B2 * 12/2013 Isaacson ..... A41F 17/00 2/117
8,784,347 B1 7/2014 Smith
8,910,317 B2 * 12/2014 Decker ..... A41D 13/0002 2/227
8,959,665 B1 * 2/2015 Garner ..... A41F 9/00 2/236
8,966,667 B2 * 3/2015 Peck ..... A41D 1/08 2/227
9,119,424 B2 * 9/2015 Kakuno ..... A41C 1/00
9,144,252 B1 * 9/2015 Kostrzewski ..... A41D 1/08
2002/0115378 A1 8/2002 Nagaoka
2003/0070209 A1 * 4/2003 Falone ..... A41D 13/015 2/412
2003/0233698 A1 * 12/2003 Villalobos ..... A41D 1/06 2/227
2004/0006811 A1 1/2004 McKenzie
2004/0016043 A1 * 1/2004 Uno ..... A41B 9/001 2/400
2004/0111781 A1 * 6/2004 Miyake ..... A41C 1/003 2/69
2004/0255358 A1 * 12/2004 Ota ..... A41D 13/0015 2/69
2005/0091728 A1 5/2005 Rocha
2006/0169004 A1 * 8/2006 Belluye ..... A41D 1/084 66/177
2006/0230488 A1 * 10/2006 Rudolph ..... A41D 1/086 2/69
2006/0253960 A1 * 11/2006 Horn ..... A41D 1/06 2/227
2007/0015439 A1 * 1/2007 Fu ..... A41C 1/003 450/100
2007/0082189 A1 * 4/2007 Gillette ..... B32B 5/18 428/304.4
2007/0118954 A1 * 5/2007 Lee ..... A41C 1/003 2/69
2007/0149093 A1 6/2007 Lutz
2007/0186328 A1 * 8/2007 Bulian ..... A41D 1/084 2/69
2008/0010725 A1 1/2008 Yoo
2008/0034476 A1 2/2008 MacKinnon
2008/0083055 A1 * 4/2008 Onda ..... A41D 13/0015 2/455
2008/0120757 A1 * 5/2008 Nakazawa ..... A41D 13/0015 2/22
2008/0194181 A1 * 8/2008 Sudo ..... A41C 1/003 450/123
2008/0201830 A1 * 8/2008 Ishida ..... A63B 21/4025 2/467
2008/0216203 A1 * 9/2008 Duncan ..... A41D 1/086 2/22
2008/0271226 A1 * 11/2008 Erana Ahumada .... A41B 9/001 2/228
2009/0007311 A1 * 1/2009 Semba ..... A41D 1/08 2/69
2009/0025115 A1 * 1/2009 Duffy ..... A41D 13/0015 2/69
2009/0031470 A1 * 2/2009 Ishikawa ..... A41D 1/06 2/69
2009/0113596 A1 * 5/2009 Young ..... A41D 13/0015 2/69
2009/0113598 A1 5/2009 Maier
2009/0300826 A1 * 12/2009 Harimoto ..... A41B 9/02 2/403
2010/0011479 A1 * 1/2010 Onoda ..... A41D 7/00 2/67
2010/0024101 A1 * 2/2010 Berner, Jr. ..... A41D 13/0015 2/455
2010/0095442 A1 * 4/2010 Kuipers ..... A41D 1/084 2/466
2010/0107299 A1 * 5/2010 Ota ..... A41D 13/0015 2/69
2010/0162466 A1 * 7/2010 Fukuyo ..... A41D 1/08 2/227
2010/0162470 A1 * 7/2010 Kim ..... A41B 9/02 2/403
2010/0192283 A1 * 8/2010 Kim ..... A41D 1/06 2/227
2011/0099677 A1 5/2011 Mamiye et al.
2011/0173741 A1 * 7/2011 Georgis, Jr. ..... A41B 9/02 2/400
2011/0179552 A1 7/2011 Bickley et al.
2011/0209267 A1 * 9/2011 Rush ..... A41D 1/08 2/228
2011/0214216 A1 * 9/2011 Zarabi ..... A41D 27/02 2/69
2011/0265255 A1 * 11/2011 Hyndman ..... A41B 9/12 2/466
2011/0289648 A1 * 12/2011 Burke ..... A41B 9/00 2/69
2012/0060253 A1 3/2012 Bergin (Nee Madonna) et al.
2012/0096627 A1 4/2012 Gosse
2012/0174282 A1 * 7/2012 Newton ..... A41D 13/0015 2/69
2012/0204313 A1 * 8/2012 Evans ..... A41F 5/00 2/70
2012/0210487 A1 * 8/2012 Albin ..... A41D 13/0015 2/69
2013/0036530 A1 * 2/2013 Bartlett ..... A41D 1/06 2/212
2013/0160189 A1 * 6/2013 Yang ..... A63B 21/0552 2/227
2013/0239294 A1 * 9/2013 Clement ..... A41D 1/08 2/228
2013/0305425 A1 * 11/2013 Zarabi ..... A41D 1/06 2/69
2013/0312157 A1 * 11/2013 Freddi ..... A41D 1/06 2/227
2013/0316617 A1 * 11/2013 Freddi ..... A41D 1/08 450/95
2014/0026293 A1 * 1/2014 Quistian, Jr. ..... A41D 1/06 2/227
2014/0096301 A1 * 4/2014 Waller ..... A41D 7/00 2/67
2014/0143930 A1 * 5/2014 Kuraoka ..... A41D 1/06 2/79
2014/0150166 A1 * 6/2014 Hall ..... A41D 1/06 2/227
2014/0165264 A1 * 6/2014 Safran ..... A61F 5/0193 2/228
2014/0165265 A1 * 6/2014 Tulin ..... A41D 1/06 2/234
2015/0107000 A1 * 4/2015 Tanaka ..... A41D 13/0015 2/227
2015/0201679 A1 * 7/2015 Wong ..... A41D 27/00 2/236
2015/0208744 A1 * 7/2015 Smith ..... A41D 1/08 2/400
2015/0313302 A1 * 11/2015 Boyle ..... A41D 27/28 2/228

FOREIGN PATENT DOCUMENTS

CN 2676656 Y 2/2005
CN 101163419 A 4/2008
DE 20102650 U1 9/2001
EP 1502513 A1 2/2005
EP 1872675 A1 1/2008
EP 2666377 A1 11/2013
JP 2005256219 A 9/2005

(56) References Cited

FOREIGN PATENT DOCUMENTS

| | | | |
|---|---|---|---|
| JP | 03155508 | U | 10/2009 |
| JP | 2012021236 | A | 2/2012 |
| KR | 100973673 | B1 | 8/2010 |
| WO | 2009053935 | A1 | 4/2009 |
| WO | 2010136972 | A1 | 12/2010 |

OTHER PUBLICATIONS

Notice of Allowance dated Dec. 14, 2015 from U.S. Appl. No. 13/898,097 to Carlo Freddi et al. filed May 20, 2013.
Andrea Mariett, Expert's Report, Milan Court, Section specializing in business—Sec. A, civil case R. G. 29939/2013, pp. 1, 22-28, 68, Nov. 15, 2013.
Feb. 11, 2015, Office Action for U.S. Appl. No. 13/898,097, Freddi et al. filed May 20, 2013.
Search Report dated Jan. 30, 2013 from Italian priority application MI2012A 000904.
Search Report dated Jan. 30, 2013 from Italian priority application MI2012A 000907.
Unpublished U.S. Appl. No. 13/898,097 to Freddi et al, filed May 20, 2013.

* cited by examiner

GARMENT FOR SHAPING THE FEMALE BUTTOCKS AND HIPS, IN PARTICULAR A SPORTS GARMENT FOR DANCE OR GYMNASTICS

The present invention relates to a garment for shaping the female buttocks and hips.

In the present context a garment means an article of clothing to be used either as an article which remains in view when worn, or an article which can be worn under or inside another article, such as an article to act as shaping lining provided inside pants and connected to them in conventional manner (for example at the waist part of the pants). The garment according to the invention may or may not have parts adapted to cover the legs.

A garment in the present context is therefore meant to also include shorts (i.e. garments without parts adapted to cover the legs), short-leg pants and pants with legs of any form and length.

The garment is particularly suitable for sports use and in particular for fitness training, dance and gymnastics. Garments able to shape the buttocks and hips of the wearer have been known for some time, these garments being generally of the type to be connected to the inside of pants, see for example US2007118954 A1, U.S. Pat. No. 5,888,118 or EP1872675.

Known garments on the one hand comprise a large number of parts made of different fabrics, making their production relatively lengthy and complicated, and on the other hand are not always able to cause the fabric to adhere to the buttocks and hips, so as to highlight and emphasize those parts of the body.

An object of the invention is to provide a garment able to shape the buttocks and hips of the wearer, while at the same time causing the fabric of the pants to adhere to the buttocks and hips such as to highlight the shapes of said parts of the body.

A further object is to provide a garment able to highlight each of the two parts of the buttocks separated by the intergluteal cleft.

A further object is to provide a garment which comprises a limited number of components, is simple and quick to produce and can be manufactured industrially with fabrics of conventional type.

A further object is to provide a set of garments which for the appropriate size are adaptable to the different forms of the buttocks of the person who is to wear the pants.

A further object is to provide a garment which is suitable for use during sporting activity and in particular for the practice of gymnastics, fitness training and dance.

These and other objects which will be apparent to an expert of the art are attained by a garment in accordance with the accompanying claims.

Figure 2:
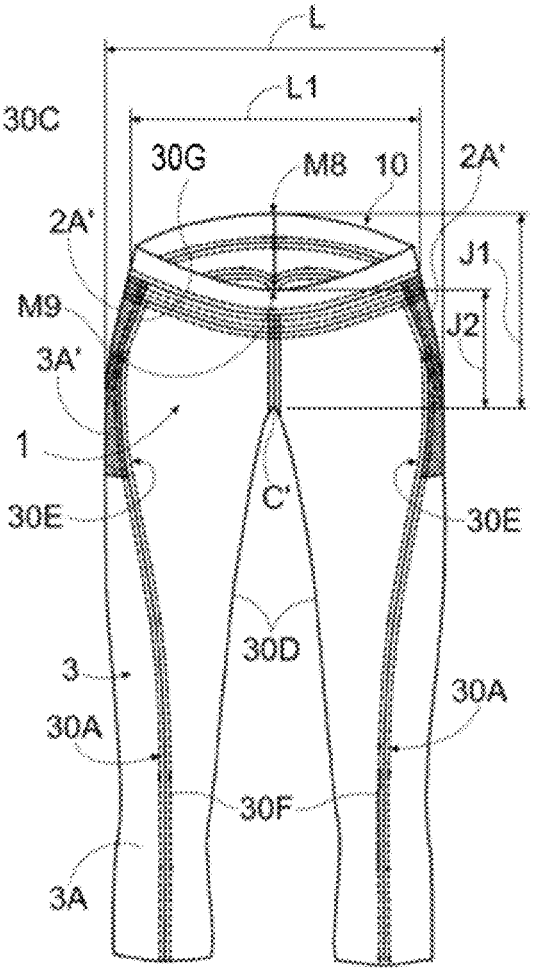
Figure 3:
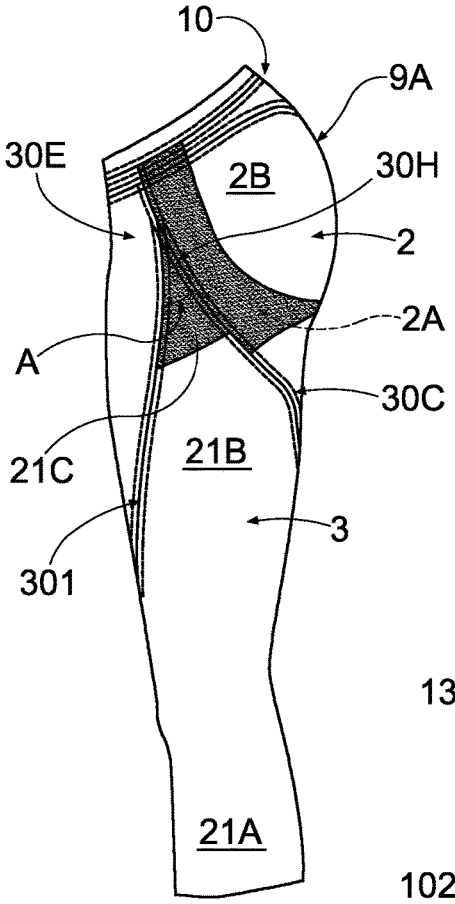
Figure 5:
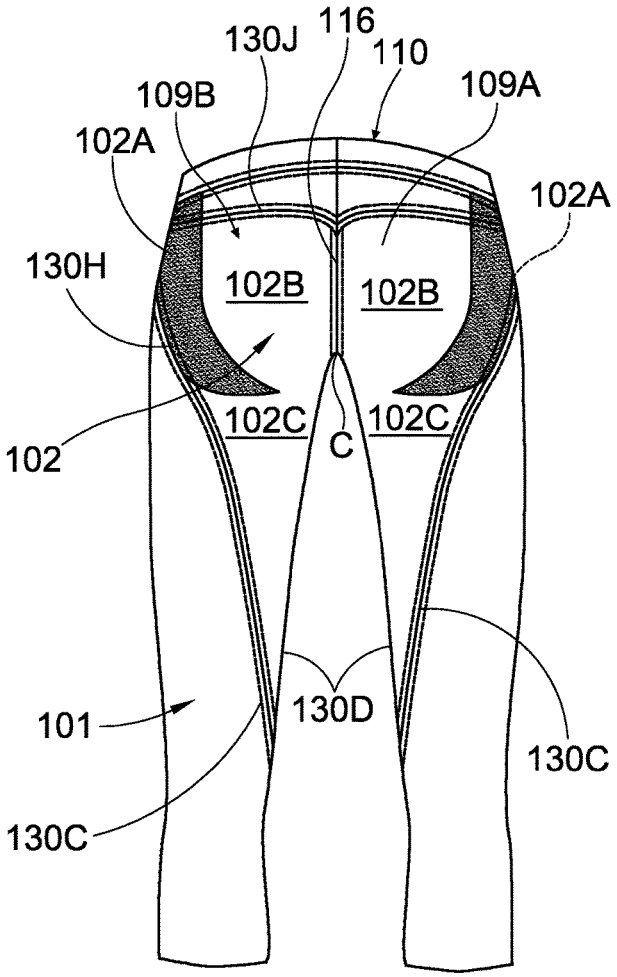
Figure 4:
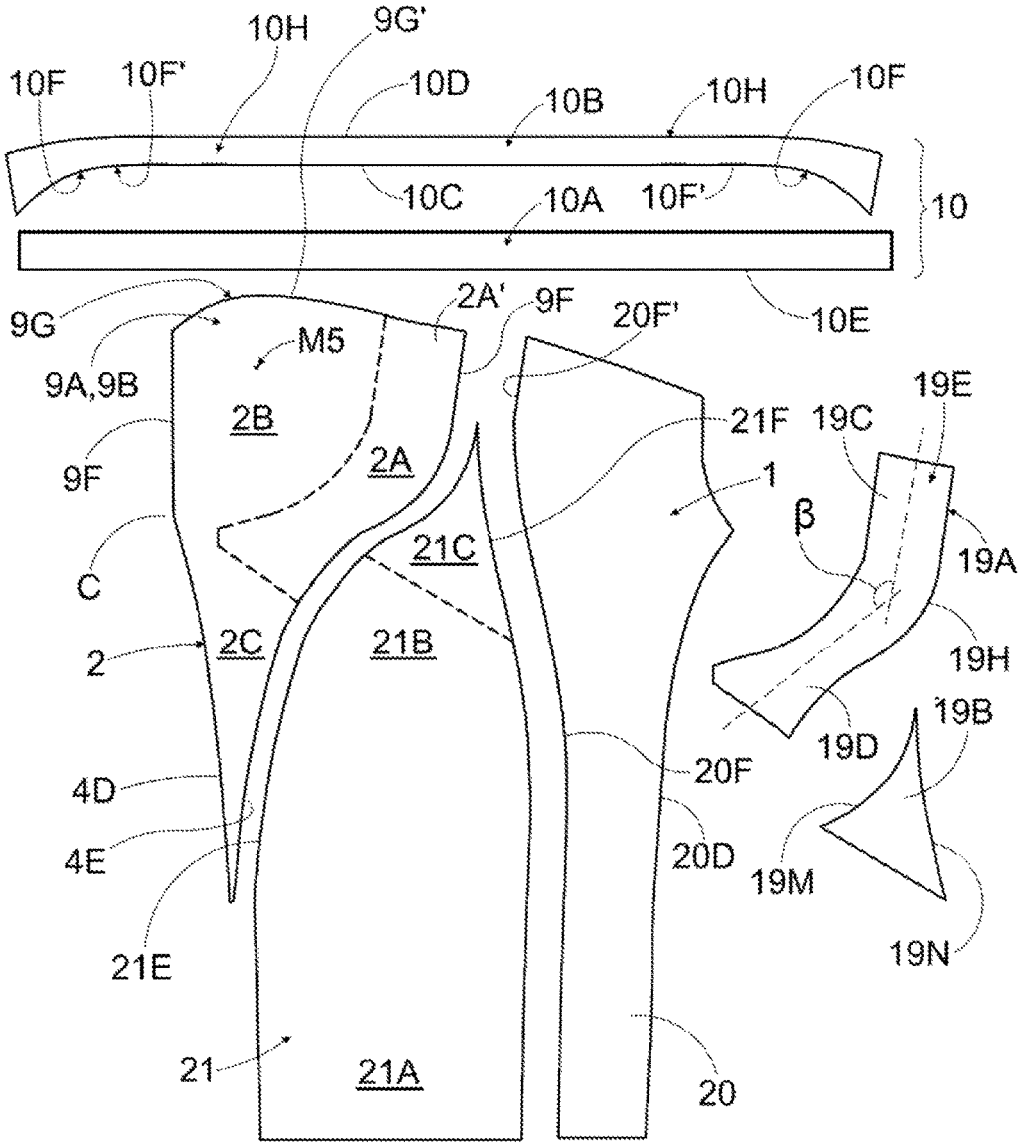
Figure 6:
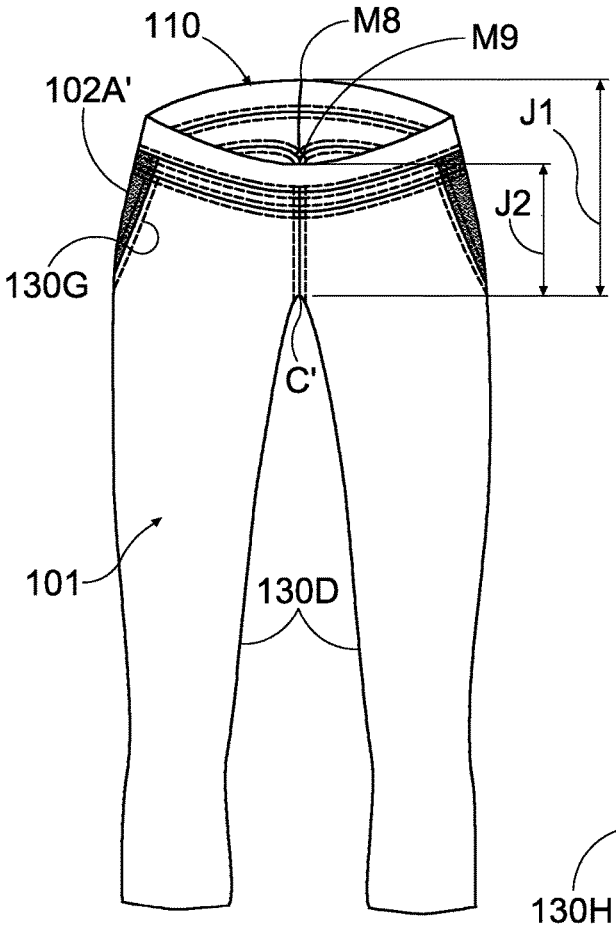
Figure 7:
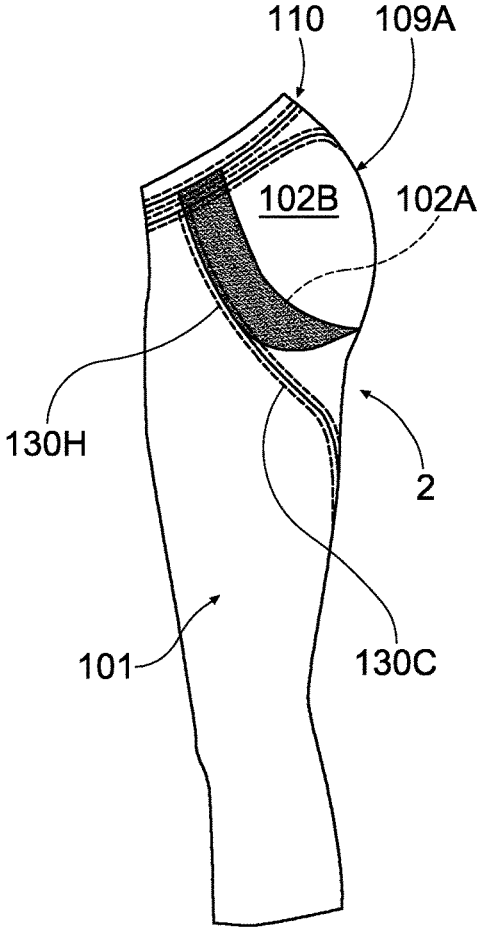
Figure 8:
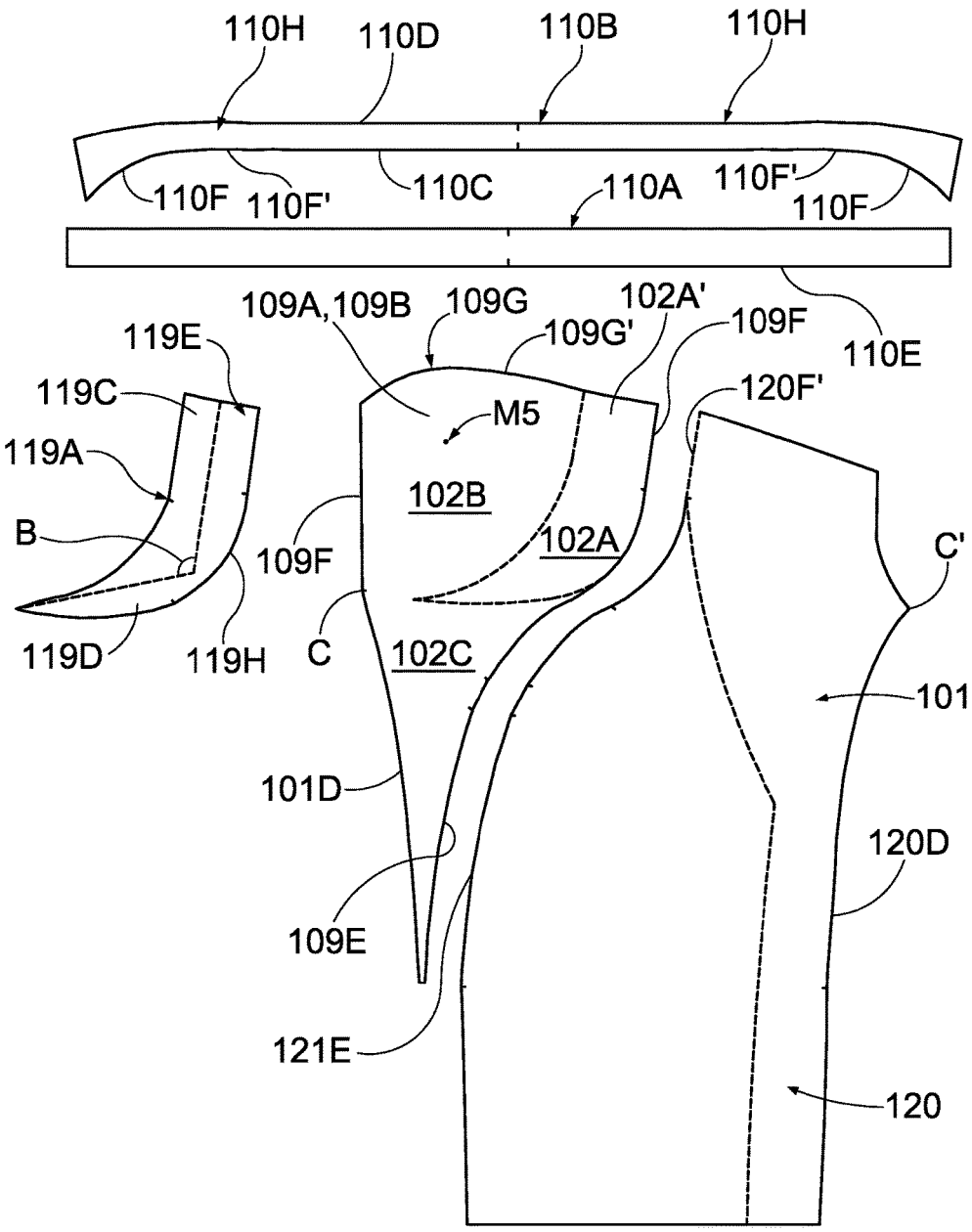
Figures 9, 10, 11:
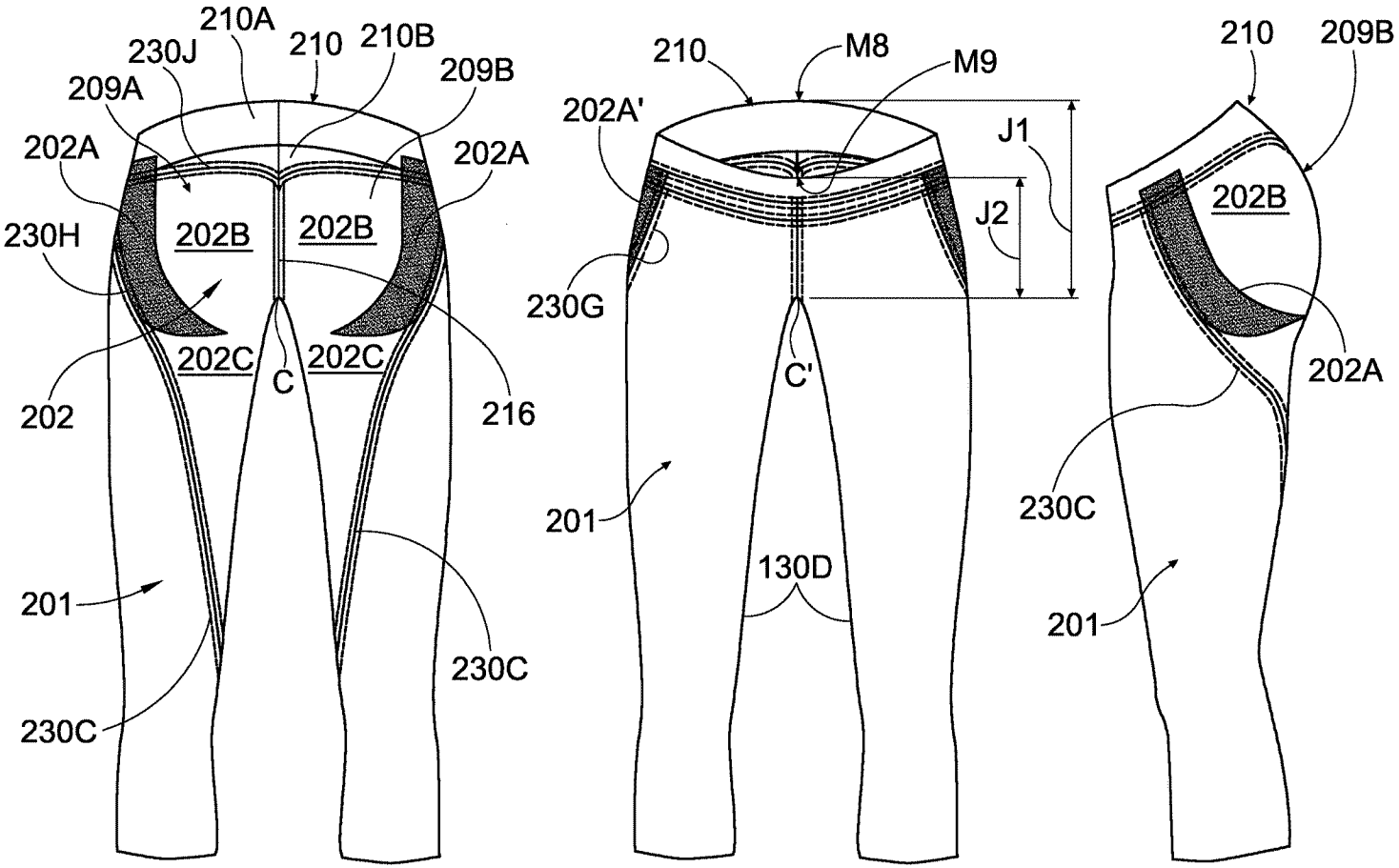
Figure 12:
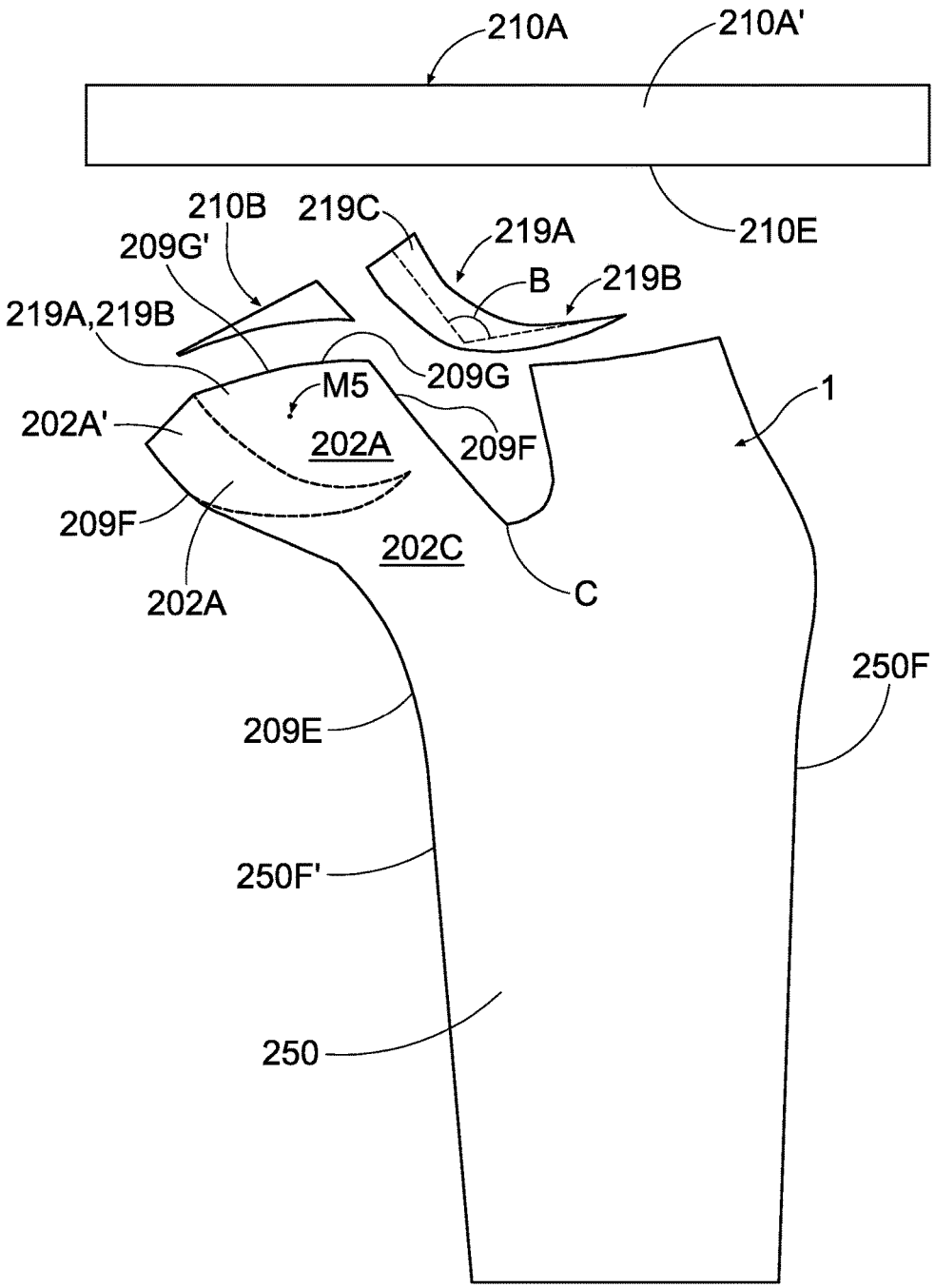
Figure 13:
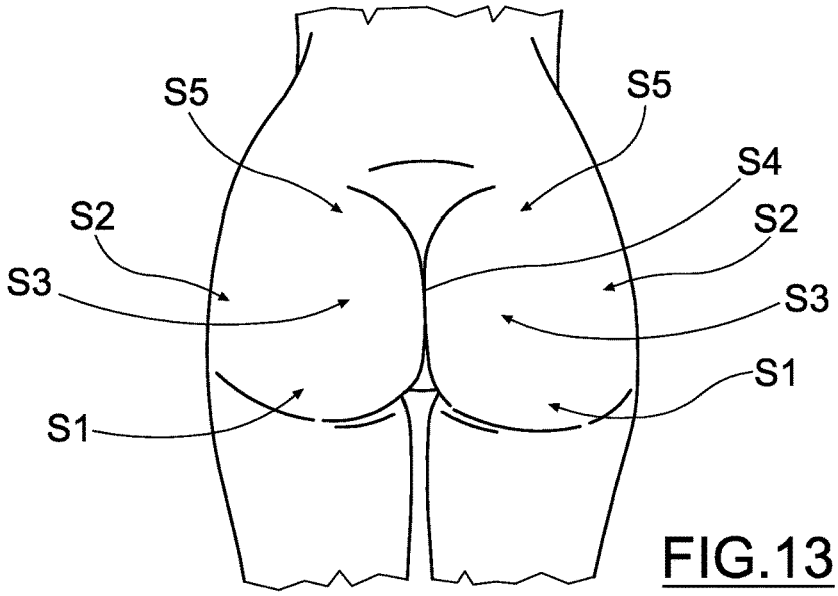
Figure 14A:
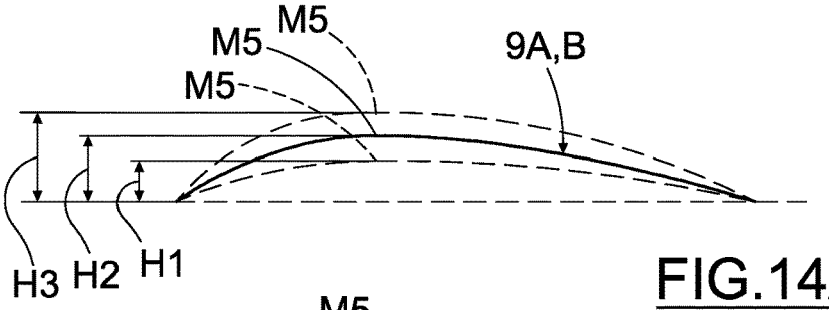
Figure 14B:
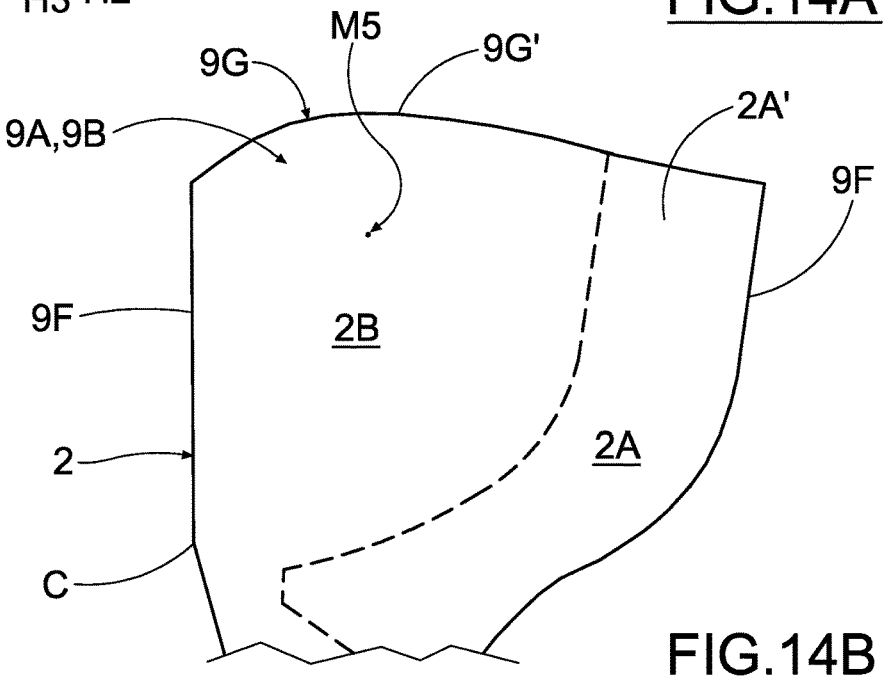
Figure 15:
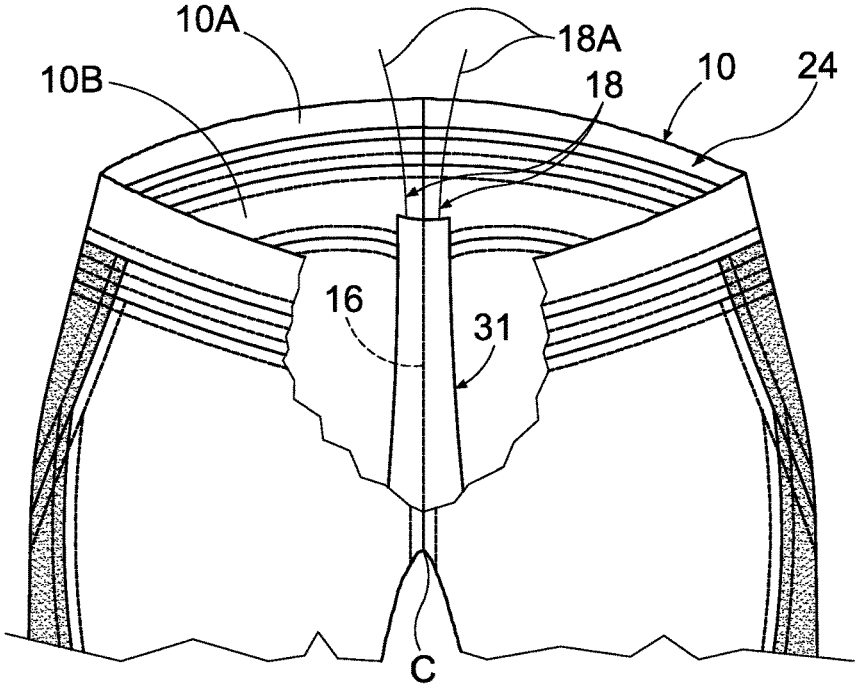
Figure 16:
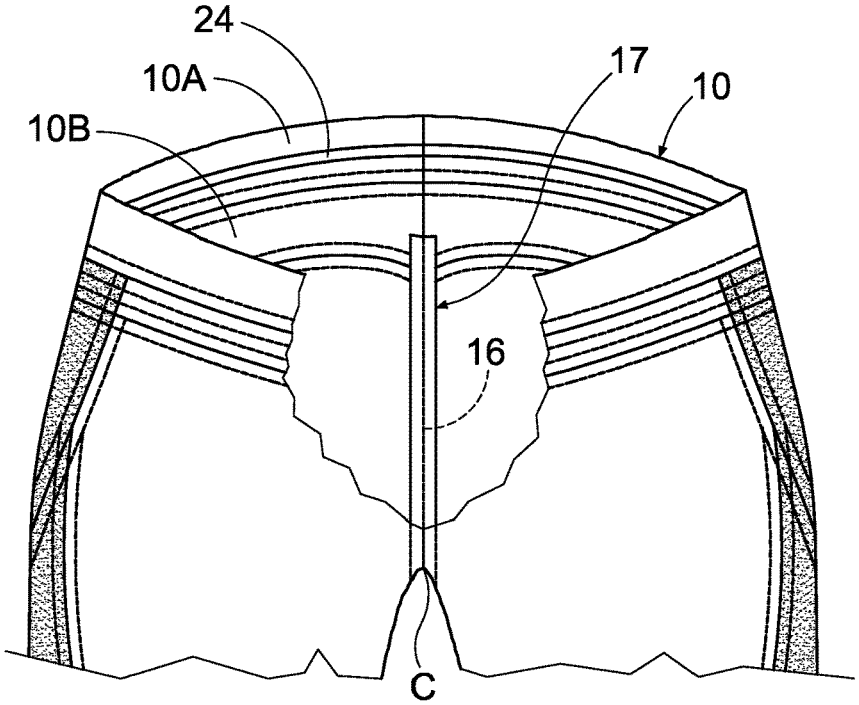

The present invention will be better understood from the accompanying drawings, which are provided by way of non-limiting example and in which:

FIGS. 1, 2, 3 are respectively a rear, front and lateral schematic view of a first embodiment of a garment according to the invention, FIG. 4 is a plan view of the main elements for producing the pants of FIGS. 1-3, before being sewn together, FIGS. 5, 6, 7 are respectively a rear, front and lateral schematic view of a second embodiment of a garment according to the invention, FIG. 8 is a plan view of the main elements for producing the pants of FIGS. 5-7, before being sewn together, FIGS. 9, 10, 11 are respectively a rear, front and lateral schematic view of a third embodiment of a garment according to the invention, FIG. 12 is a plan view of the main elements for producing the pants of FIGS. 9-11, before being sewn together, FIG. 13 is a perspective schematic view of buttocks, FIGS. 14A and 14B are respectively a perspective cross-sectional view and a perspective plan view of a detail of the garment, and FIGS. 15 and 16 are partial front views of two further variants of the garment regarding a detail of the rear central seam.

With reference to FIGS. 1-4, these show a garment according to the invention, which in the particular embodiment illustrated are women's sports pants, in particular for fitness training, dance or gymnastics, of the type adapted to partially cover the legs to below the knee.

In FIG. 1 item 305 is a seam. In FIG. 2 Item 3A is a portion of lateral part 3.

It should be noted that according to the invention, the garment can have legs of any length, width and shape, and can also be substantially without legs (for example to produce a garment of "shorts" type).

The garment comprises:

- a rear part 2 adapted to entirely cover the buttocks with the exception of their upper terminal portion S5,
- a front part 1 adapted to at least partially cover the abdomen,
- and a waist part 10 adapted to cover at least said terminal upper portion S5 of the buttocks.

The front part 1 having a front fork C'. Advantageously, the garment also comprises a lateral part 3 joining together the first rear part 2 and the second front part 1, at the garment legs.

According to the invention, the rear part 2 consists of two rear elements 9A, 9B, each of which comprises first regions 2A (shown by hatching in FIGS. 1, 3, 4), adapted to cover: a lower terminal portion S1 of the buttocks, a lateral portion S2 of the buttocks, and a portion of the hips; and second regions 2B adapted to cover: a central portion S3 of the buttocks and a lower central portion of the buttocks at the rear fork C of the garment.

According to the invention, the rear part 2 comprises an insert 19A (FIG. 4) connected to its inner face at each of its first regions 2A, to increase the elastic modulus and/or tenacity of said first portions relative to the second regions portions 2B of said rear part 2.

According to the invention, the two elements 9A, 9B of the rear part 2 are connected together along respective lateral edges 9F by a central rear seam 16, to be positioned on the intergluteal cleft S4 of the buttocks; before being sewn together, said lateral edges 9F are of rectilinear shape (preferably a shape comprising a single rectilinear line) in plan view, facilitating the insertion of the seam 16 of said edges into the intergluteal cleft S4 of the buttocks and the adherence of said two elements to the buttocks when the pants are worn.

The rear part 2, the front part 1 and the lateral parts 3 consist of elements, illustrated in detail hereinafter, joined together by vertically extending front seams 30A, rear seams 30C and internal seams 30D. Advantageously the front seams 30A comprise an upper portion 30E (FIG. 2) of arched extension, which starting from the waist widens towards the hips and then again narrows towards the interior of the thigh, connecting to a substantially straight lower portion 30F of said front seam 30A. By virtue of this particular shape, the front seam 30 reproduces and highlights the front muscular bands of the thighs.

The particular shape of the front seam 30A is possible because the front part 1 of the garment is formed, for each leg, by an elongate element 20 (FIG. 4) which advantageously comprises the edge 20F to be sewn to the corresponding edges 9F and 21F of the rear part 2 and lateral part 3, which in its upper part, above the knee, comprises a portion 20F' which is curved such that in its upper part at the hips, the front part 1 of the garment has a width L1 less than the overall width L of the garment when viewed frontally (FIG. 2). Consequently when viewed frontally, the garment comprises, laterally at the hips, portions 2A' (FIG. 2) and 3A' which are prolongations of the garment front part, of the rear part 2 and of the lateral part 3. By virtue of this particular curvature of the outer edges 20F of the elements 20 and consequently of the upper curved front portions 30E of the seams 30A, and by virtue of the prolongations 2A' and 3A' of the rear part 2 and lateral part 3, when the garment is worn a visual slimming effect of the hips is achieved.

The rear seams 30 are also arranged to reproduce and highlight the rear muscular bands of the buttocks and thighs, for which purpose they comprise a first upper portion 30G (FIG. 2) which extends from the waist part 10 and extends into the front part of the pants to connect to an intermediate portion 30H of the seam 30 which extends about the outer perimeter of the lateral portions S2 of the buttocks, and finally connects to a terminal portion 30I of the seam 30 which passes through the rear of the thighs to below the knee. The upper portion 30E of the front seam 30A and that 30H of the rear seam 30C join together at the hips to form an acute angle A (FIG. 3) between 15° and 40° and preferably about 20°, such as to create a visual elongation and slendering effect of the hips.

Preferably the garment rear part 2 comprises, in addition to the aforesaid first regions 2A and second regions 2B, third regions 2C (FIG. 1) adapted to partially cover the legs below the fork C.

FIG. 4 shows in plan view, before being sewn to the other parts of the garment, one of the two elements (with reference to FIG. 1, this is the right hand element indicated by 9B) which form the rear part 2 of the garment, the other element being specularly identical.

The element 9B presents the already mentioned straight edge 9F ((preferably having the shape of a single rectilinear line) to be sewn to the corresponding edge 9F of the other element 9A which forms the rear part 2 of the garment, and further edges 9D, 9E, 9F to be sewn to corresponding edges 20D, 20F, 21E of the elements 20 and 21 (FIG. 4) which form the front part 1 and lateral part 3 of the pants.

Advantageously, the upper edge 9G is curved (arched towards the rear fork C) and is to be sewn to corresponding portions 10F of the lower edge 10C of the lower element 10B of two elements 10A and 10B forming the waist part 10. It should be noted that these end portions of the edge 10F have a substantially straight section 10F' to be sewn to an arched section 9G' of the upper edge 9G of the elements 9A, 9B, and that consequently between these edges 9G' and 10F' when brought together for sewing, a fabric-less region is created which is closed by the rear seams or darts 30J (FIG. 1). By virtue of this particular conformation of the edges 9G' and 10F', the regions 2B which surround the insert-free central part of the buttocks are at least partially pulled upwards by the waist 10, facilitating penetration of the seam 16 into the intergluteal cleft and also favoring the retentive and upward thrust action on the buttocks by the regions 2A presenting the inserts 19A.

Advantageously, the elements 9A and 9B also present the subregions 2A' (FIG. 2) of the regions 2A presenting the insert 19A, which also extend into the front part of the garment to ensure a retentive and slimming effect on the hips of the garment wearer. The insert 19A (represented by hatching in FIGS. 1-3) is arranged to make the two regions 2A of the rear part 2 comprising said inserts less elastic but tougher and therefore increase a retentive effect. These inserts 19A are preferably of panel shape and comprise a substantially vertically extending upper portion 19C and a lower portion 19D inclined to the upper portion (the axes of symmetry of the two portions form an angle β (FIG. 4) between 100° and 160 and preferably about 130°). Said inserts 19A are dimensioned and shaped such as to cover a portion of the hips and a lateral peripheral portion of the buttocks without however extending as far as the intergluteal cleft, or the rear fork C of the pants. In other words the inserts 19A are dimensioned and shaped such as to cover a lower terminal portion S1 of the buttocks, a lateral portion S2 of the buttocks, and a portion of the hips, but not also the central portions S3 of the buttocks and a lower central portion of the buttocks at the intergluteal cleft.

These inserts are advantageously made of a plastic material, preferably of polyurethane and more preferably of silicone, which is made to adhere to the inner face of the garment fabric. These inserts preferably present the following characteristics:

- weight between 30 and 130 g/m$^2$
- thickness between 0.02 and 0.5 mm
- surface continuous or presenting a plurality of holes (to facilitate breathability).

These inserts are preferably made to hot-adhere under pressure by techniques conventional to the expert of the art.

For example the inserts are of the type marketed by the Italian company A. R. T. Line s.r.l.

The inserts 19A are arranged to form in the garment rear part 2, made advantageously of a single fabric, two panels which, having a greater elastic modulus and/or greater tenacity than the other insert-free parts of the garment, have a double purpose: on the one hand these two panels have a retentive effect on the hips and on the peripheral lateral portions of the buttocks, and on the other hand, in particular the lower portions 19D of the inserts 19A have the effect of supporting and upwardly thrusting the central parts S3 of the buttocks.

Preferably the elastic modulus and/or tenacity of the regions 2A of the rear part 2 comprising the inserts 19A is greater than a value between 5% and 30% more, and preferably 10% more, than the corresponding elastic modulus and tenacity values of the other adjacent garment portions without these inserts, for example of the fabric of the central regions 2B of the garment rear part 2.

It must be emphasized that the insert thickness should be as small as possible to as far as possible prevent their being visible when the garment is worn. For this reason it is advantageous that if possible, the outer edges of the inserts extend such as to coincide with the garment seams. In this respect, it can be seen that the most outer edge 19H of the insert 19A is superimposed on the upper section 30H of the rear seam 30C, and the edges 19M ad N of the insert 19B coincide with the rear seams 30C and front seams 30A.

Moreover advantageously, the insert 19A does not extend throughout the entire lower band of the buttocks, or rather not throughout the entire perimeter of the buttocks, to prevent an unpleasant "stepped" effect being created when the garment is worn.

Advantageously, to conform better to the more projecting and rounded central parts of the buttocks, the regions 2B of the garment rear part instead of having a flat two-dimensional shape can have a three-dimensional cup shape (see FIGS. 14A, 14B), or rather a hollow convex shape with a perimetral edge of irregular shape. Said perimetral edge is composed of three sections: a lower section 9G, a straight lateral section 9F and a section 9H which divides the region 2B from the region 2A.

According to one aspect of the invention the regions 2B must adhere as much as possible to the buttocks, with their seam 16 (FIG. 1) penetrating into the intergluteal cleft S4, such as to highlight and upgrade the appearance of the buttocks. These objects are achieved according to one aspect of the invention by the particular shaping of the regions 2B and in particular by the fact that the pants of the invention are advantageously produced as a set of pants having all the same size but with the regions 2B having different convexities for each garment of the set, so as to better adapt to the anatomical characteristics of the pants wearer (see FIGS. 14A and B). Consequently, according to the invention, a garment having a determined size, for example size 40, is produced in a plurality, for example three, of different conformations each having a particular buttock "size", i.e. with three different types of regions 2B of the rear part 2.

Preferably all the regions 2B have a substantially equal perimetral shape (the perimetral dimensions could possibly be different) and different convexities. Hence, for example, (with reference to FIG. 14A), a first type of region 2B has a maximum point M5 at a first height H1, for example between 0 and 1 cm, a second type of region 2B has the maximum point at a second height H2 greater than the first, for example between 1 and 2 cm, and a third type of region 2B has the maximum point at a third height H3 greater than the second, for example between 2 and 3 cm.

Preferably the three-dimensional form of the regions 2B is obtained by a conventional fabric preforming technique, of type similar to that used for some time in the brassiere cup production sector. This preforming technique enables regions 2B to be obtained without internal sewing (the cups comprise seams only along their outer edges 9G and 9F) and can hence adhere better to the buttocks. As this production technique is conventional for the expert of the art, it will not be further described.

According to a further aspect of the invention for facilitating insertion of the seam 16 of the two parts 9A, 9B of the rear part 2 into the intergluteal cleft, and hence enabling the two parts to better bind the buttocks, the edges 9F of the two parts to be sewn together have the already described straight shape. It should be noted that in known pants the sewing edges provided at the line of central symmetry of the garment are always curved, i.e. a shape which in the finished garment aids buttock roundness, such that when the pants are worn, as at the intergluteal cleft there is a "lack of fabric" relative to the roundness of the buttock, the fabric is pulled into the intergluteal cleft. This effect is obviously more accentuated the more the fabric is elastic and deformable.

To improve insertion of the seam 16 into the intergluteal cleft, a conventional elongated elastic element 17 is also sewn to said seam (FIG. 16), sewn preferably to the interior of the pants, and in a state of pretension, such that when the pants are worn, this elongated elastic element pulls the seam 16 and thrusts it into the intergluteal cleft. The same effect can also be obtained with a cord 18 (FIG. 15), provided inside the pants and presenting a section sewn to the fork C of the pants and for the rest slidable within a slot 31 provided in the seam 16 and with the free ends 18A emerging slightly below the garment waist 4. By pulling the cord 18 and knotting its ends 18A the seam 16 can be pretensioned such that when the pants are worn, it enters the intergluteal cleft.

It should be noted that the different solutions described to this point to facilitate insertion of the rear central seam 16 of a garment into the intergluteal cleft, or rather the straight edge at the central rear seam 16, and/or insertion of a pretensioned elastic element 17 into the seam, and/or insertion of a cord 18 into the seam, are all solutions which can be used even in pants of conventional type to the expert of the art. These technical solutions are therefore not to be considered as limited to the garment of the invention.

The waist part 10 comprises a lower elongated element 10B and an upper element 10A substantially of conventional shape to be joined together along edges 10D and 10E. The lower element 10B has a lower edge 100 presenting the two end portions 10F to be joined to the upper edge 9G of the elements 9E, 9B of the rear part 2 as already described. To improve positioning of the waist part 10 and prevent its slippage downwards, the inner face of the waist elements 10A, 10B, or at least that of the upper element 10A, comprises an elastic tape 24 which remains in view (FIG. 16), for example of silicone or with a siliconized outer surface, to increase adherence of the waist 4 to the skin.

Advantageously an upper end portion 19E of the inserts 19A also extends onto two portions 10H of the lower element 10B of the waist part 10, such as to prolong the retention and shaping effect even in the waist part.

Preferably according to the invention, the height J1 (FIG. 2) of the maximum point M8 of the rear portion of the waist part 10 from the front fork is significantly greater than the corresponding height J2 of the maximum point M9 of the front portion of the waist 4.

Preferably the greater height J2 is greater than the lesser height J1 by a distance between 30% and 70% of J1, more preferably this distance being equal to about 50% of J1 (i.e. J2=J1+50% J1). For example, in a garment of size S, J1=18 cm and J2=27 cm. By virtue of this particular shaping of the garment, which has a very high waist on the rear and a low waist on the front, on the one hand the slimming effect of the hips is accentuated and on the other hand the waist part 10 assumes a position substantially above or approximately at the upper edge of the buttocks, i.e. approximately at the hip joint when the garment is worn.

From this position, by virtue of the particular shape of the previously described components of the rear part of the garment, the waist line 10 and the inserts 19A are able to exert an upwardly directed traction force on the regions 2B of the rear part 2, resulting in:

- an at least partial upward thrust at least of the central parts of the buttocks;
- a thrust on the central rear seam 16 of the garment into the intergluteal cleft;
- a significant adherence of the garment rear fabric to the buttocks.

This combination of effects results overall in a reshaping of the shape of the buttocks of the garment wearer.

The lateral part 3 of the garment comprises the element 21 which presents a lower portion 21A of substantially rectangular shape to lowerly bind the legs, and an upper portion 21B of approximately triangular or pointed shape to upperly and laterally bind the legs, and comprising a triangular terminal portion 21C bounded by the upper sections 30E and 30H respectively of the garment front seam 30A and rear seam 30C. At the upper face of this triangular terminal portion 21C of the garment lateral part 3 a further insert 19B (FIG. 4) is provided, of a material identical to that of the previously described insert 19A. Because of this insert 19B, the triangular terminal portion 21C of the garment lateral part 3 presents an increased tenacity and/or an increased elastic modulus and is therefore able (as is the region 2A of the rear part 2) to retain and fashion the hips of the garment wearer.

All parts of the garment, except the inserts 19A and 19B, are advantageously made of a single fabric, presenting identical technical characteristics.

The garment of the invention is preferably made of a conventional fabric for sporting use, for example:

a synthetic microfibre fabric, for example nylon;

or a fabric comprising: a natural fibre, for example cotton (in a percentage between 50% and 80%), a microfibre, for example nylon (in a percentage between 10% and 30%), and an elastomer, for example elastan (in a percentage between 5% and 20%);

or a fabric comprising: a natural fibre, for example cotton (in a percentage between 50% and 80%), and a microfibre, for example nylon (in a percentage between 10% and 40%);

or a fabric comprising: a natural fibre, for example cotton (in a percentage between 50% and 80%), and an elastomer, for example lycra (in a percentage between 10% and 40%).

By way of example, fabrics suitable for the purpose are those fabrics marketed with the trademark DIWO (dry in wet out) 200 cotton stretch or DIWO 140 cotton fleece or DIWO techno fleece of the Italian company Freddy. The garment could also be made from other usual technical fabrics for sporting garments of high breathability type. High fabric breathability is achieved for example by virtue of the fabric composition characteristics, for example in polypropylene fabrics, or by fabric construction characteristics, for example in the aforesaid DIWO fabric, or by breathability pre-treatment characteristics, for example by chemical additives applied onto fabrics of all types.

The garment can also be made with a fabric of knitted type, for example double jersey, jersey, ribbed, 1:1 ribbed, interlock, plush, or single jersey.

It should be noted that the aforestated DIWO fabric is a knitted fabric of jersey construction.

FIGS. 5-8 show a second embodiment of a garment according to the invention in which production is simplified, those garment parts in common with the already described garment not being further described in detail and being indicated by the same reference numeral as FIGS. 1-4, plus 100.

In this second embodiment, the substantial differences compared with the previously illustrated garment are related to the fact that the garment comprises only two pairs of elements, namely the pair 109A, 1098 and the pair 120, which when sewn together form the front part 101, rear part 102 and lateral part 103 of the garment. According to this variant, the elements 120 (FIG. 8) which once sewn together form the front part 101 and lateral part 103, also comprise the element which in the previous embodiment was indicated as the element 21, forming the garment lateral part 3.

Furthermore, the garment according to this variant no longer presents the triangular second insert 19B, but advantageously presents an insert 119A with a point-shaped lower portion 119D.

It should be noted however that the insert 119A could also be used in the garment of FIGS. 1-4 instead of that indicated in said figures with the number 19A and, vice versa, the insert 19A could be used in the garment of FIGS. 5-8 instead of that with the pointed lower portion 119A. The garment of this embodiment comprises two parts less than the previous embodiment, it being simpler and quicker to produce. FIGS. 9-12 show a third embodiment of a garment according to the invention, which further simplifies its production, those parts in common with the previously described garment not being further described in detail and being indicated by the same reference numeral as FIGS. 1-4, plus 200.

In this third embodiment, the substantial differences compared with the previously illustrated garment are linked to the fact that the garment comprises only two elements 250 which when sewn together form the front part 201, rear part 202 and lateral part 203 of the garment.

In this variant, the element 250 (FIG. 12) comprises in one piece the elements 20, 21, 9A, which in the previous embodiment were indicated as elements forming respectively the front part 1, the lateral part 3 and the rear part 2. Furthermore, in this embodiment the waist part 210 comprises a single element 210A in the form of a rectangular band to which two elements 210B are secured at its lower rear edge to connect the upper edge 209G, 209G' of the elements 209A, 209B of the rear part 2 to the lower edge 210E of the waist element 210A'.

Hence according to this variant, the rear seam 230C (FIG. 9) and the lateral seam, indicated by 30D and 130D in the previous embodiments, are no longer present.

All the other technical characteristics and possible variants previously described with reference to the first and second embodiment again remain unvaried for this third embodiment.

Finally it should be noted that the aforedescribed embodiments have been provided by way of example and that numerous variants are possible, all falling within the same inventive concept, and that, in particular, the shape and/or dimensions, and/or the materials of the different parts of a garment according to one of the embodiments could also be used in another of the embodiments.

The invention claimed is:

1. A woman's sports pants garment for shaping buttocks and hips of a female, comprising:

a front part adapted to at least partially cover an abdomen of the female, a first rear part adapted to entirely cover the buttocks with the exception of an upper terminal portion of the buttocks, a second rear part adapted to cover said upper terminal portion of the buttocks, and a third rear part adapted to cover a waist of the female, wherein:

the first rear part, the second rear part, the third rear part, and the front part are outer parts visible when the garment is worn;

the first rear part comprises two rear elements, wherein collectively the two first rear part rear elements are adapted to entirely cover the buttocks with the exception of the upper terminal portion of the buttocks, wherein each first rear part rear element comprises a single piece of fabric comprising a first region and a second region;

each first region adapted to cover: a lower terminal portion of the buttocks, a lateral portion of the buttocks, and a portion of the hips; and each second region adapted to cover: a central portion of the buttocks and a lower central portion of the buttocks at a rear fork of the garment;

each of the two rear elements is an outer element visible when the garment is worn;

each first rear part comprises a respective insert directly attached to and covering each first rear part's inner face at each first rear part's first region but not attached to and covering each first rear part's inner face at the second region, each respective said insert for increasing the elastic modulus of the first regions relative to the second regions of the first rear part; and the two rear elements of the first rear part are connected together along respective lateral edges of the two first rear part rear elements by a central rear seam adapted to be positioned on an intergluteal cleft of the buttocks facilitating the insertion of the central rear seam of the respective lateral edges into the intergluteal cleft of the buttocks and the adherence of the two rear elements to the buttocks when the garment is worn;

an upper edge of the first rear part and a lower edge of the second rear part are connected by an upper rear seam which is arched shaped and join in a central downwardly directed V-shaped part, symmetrically divided by the central rear seam;

the second rear part and the third rear part are pieces of fabric connected by a waist rear seam;

the central rear seam extending between the first rear part two rear elements from the central V-shaped part to the rear fork, wherein the rear fork is at a crotch of the pants wherein said inserts are dimensioned and shaped such as to cover a portion of the hips and a lateral peripheral portion of the buttocks without however extending as far as the intergluteal cleft and without however extending as far as the rear fork of the pants.

2. The garment as claimed in claim 1, further comprising a cord for facilitating the insertion of the central rear seam into the intergluteal cleft, wherein only the cord is located at the central rear seam to be positioned at the intergluteal cleft, the cord slidable within a slot provided in the central rear seam and having a free end emerging below the garment waist.

3. The garment as claimed in claim 2, wherein a cord is provided inside the garment and presenting a section sewn to a fork and for the rest slidable within a slot provided in said central rear seam and with the free ends emerging from said slot at a waist part such that by pulling said cord and knotting the free ends of said cord, the central rear seam can be pretensioned to facilitate insertion of the central rear seam into said intergluteal cleft.

4. The garment as claimed in claim 1, further comprising an elongated elastic element for facilitating the insertion of the central rear seam into the intergluteal cleft the elongated elastic element sewn to the interior of the garment on said central rear seam in a state of pretension, such that when the garment is worn, said elongated elastic element pulls said central rear seam and thrusts the central rear seam into the intergluteal cleft.

5. The garment as claimed in claim 4, wherein a cord is provided inside the garment and presenting a section sewn to a fork and for the rest slidable within a slot provided in said central rear seam and with the free ends emerging from said slot at a waist part such that by pulling said cord and knotting the free ends of said cord, the central rear seam can be pretensioned to facilitate insertion of the central rear seam into said intergluteal cleft.

6. The garment as claimed in claim 1, wherein the insert to increase the elastic modulus of said first regions relative to the second regions of said rear part is an insert of a plastic material made to adhere to the inner face of said first regions.

7. The garment as claimed in claim 6, wherein the insert presents at least one of the following characteristics:

thickness between 0.02 and 0.5 mm weight between 30 and 130 g/m$^2$ has a continuous surface or has a surface presenting a plurality of holes to facilitate breathability.

8. The garment as claimed in claim 1, wherein at least the first rear part, the second rear part, the front part adapted to at least partially cover the abdomen, and a lateral part adapted to laterally cover a leg of the female, are all made of the same fabric having identical technical characteristics for all said parts, the lateral part adapted to laterally cover the leg of the female attached by a seam to a lower edge of the first rear part.

9. The garment as claimed in claim 1, wherein the second regions of the rear elements comprise a cup shaped portion.

10. The garment as claimed in claim 1, wherein a lower portion of the front part forms a front fork, wherein an upper portion of the front part forms a front waist part adapted to cover a waist of the female, wherein the first regions, of the two rear elements of the first rear part connected together along respective lateral edges of the two rear elements by the central rear seam, form the rear fork, wherein a first distance measured between a highest point of the third rear part and the rear fork of the garment is greater than a second distance measured between a highest point of the front waist part and the front fork, the difference between said first distance and the second distance being at least equal to 30% of the second distance.

11. The garment as claimed in claim 1, wherein the first rear part consists of the two rear elements.

12. The garment as claimed in claim 1, wherein each rear element of the first rear part presents an upper edge to be connected to a corresponding lower edge of the second rear part, said upper edge presents an arched shape facing the rear fork of the pants, and said lower edge of the second rear part presents a rectilinear or arched shape different from that of said upper edge, such that when said two rear elements and the second rear part are brought together before being connected together, they determine a fabric-less gap region to be closed by a seam which joins the upper and lower edges together.

13. The garment as claimed in claim 1, wherein the insert to increase the elastic modulus of said first regions relative to the second regions of said rear element is an insert of a plastic material comprising polyurethane made to adhere to the inner face of said first regions.

14. The garment as claimed in claim 1, wherein the insert to increase the elastic modulus of said first regions relative to the second regions of said rear element is an insert of a plastic material comprising silicone made to adhere to the inner face of said first regions.

15. The garment as in claim 1, wherein before being sewn together, said lateral edges of the two rear elements being of rectilinear shape in plan view.

16. The garment as in claim 1, wherein the garment is a sports garment for fitness training, dance or gymnastics.

17. A woman's sports pants garment for shaping buttocks and hips of a female, comprising:

a front part adapted to at least partially cover an abdomen of the female, and a first rear part adapted to entirely cover the buttocks with the exception of an upper terminal portion of the buttocks, a second rear part adapted to cover said upper terminal portion of the buttocks, and a third rear part adapted to cover a waist of the female, and lateral parts joining together the first rear part and the front part, at the garment legs, wherein an upper edge of the lateral part is attached to a respective lower edge of the first rear part;

wherein:

the first rear part, the front part, the third rear part and the second rear part are outer parts visible when the garment is worn, the first rear part comprises two rear elements, wherein collectively the two rear elements of the first rear part are adapted to entirely cover the buttocks with the exception of the upper terminal portion of the buttocks, each rear element of the first rear part is a single piece of fabric which comprises: first regions, adapted to cover: a lower terminal portion of the buttocks, a lateral portion of the buttocks, and a portion of the hips; second regions adapted to cover: a central portion of the buttocks and a lower central portion of the buttocks at the rear fork of the garment, and third regions adapted to partially cover legs of the female below the rear fork;

each of the two rear elements of the first rear part is an outer element visible when the garment is worn, wherein each first rear part rear element comprises a single piece of fabric comprising a first region and a second region, each of the two rear elements of the first rear part comprises a respective first insert directly attached to and covering each first rear part's inner face at each first rear part's first region but not attached to and covering each first rear part's inner face at second region to increase the elastic modulus of said first regions relative to the second regions of said first rear part;

each lateral part comprising a respective second insert connected to an inner face of an upper triangular terminal of each lateral part to increase the elastic modulus of said upper terminal portion relative to the other portions of the lateral part; and the two rear elements of the first rear part are connected together along respective lateral edges by a central rear seam to be positioned on an intergluteal cleft of the buttocks facilitating the insertion of the central rear seam of said lateral edges of the two rear elements of the first rear part into the intergluteal cleft of the buttocks and the adherence of said two rear elements of the first rear part to the buttocks when the garment is worn;

the second rear part having two rear elements connected together along respective lateral edges by an intergluteal rear seam, wherein each second rear part rear element comprises a single piece of fabric;

an upper edge of the first rear part and a lower edge of the second rear part are connected by an upper rear seam which is arched shaped and join in a central V-shaped part, symmetrically divided by the intergluteal rear seam, the intergluteal rear seam connected to and aligned with the central rear seam;

the second rear part and the third rear part are pieces of fabric connected by a waist rear seam;

the central rear seam extending between the two rear elements from the central V-shaped part to the rear fork, wherein the rear fork is at a crotch of the pants;

wherein said inserts are dimensioned and shaped such as to cover a portion of the hips and a lateral peripheral portion of the buttocks without however extending as far as the intergluteal cleft of the user and without however extending as far as the rear fork of the pants.

18. The garment as in claim 17, wherein before being sewn together, said lateral edges of the two rear elements being of rectilinear shape in plan view.

19. The garment as in claim 17, wherein a rear region of the garment covering the buttocks comprises the first rear part, the second rear part, and the third rear part, and seams of the rear region comprise only the upper rear seam, the waist rear seam, the central rear seam joining the two rear elements, and the intergluteal rear seam symmetrically dividing the central V-shaped part.

20. The garment as in claim 17, wherein the garment is a sports garment for fitness training, dance or gymnastics.

* * * * *